US010147281B2

(12) United States Patent
Zurawski et al.

(10) Patent No.: US 10,147,281 B2
(45) Date of Patent: Dec. 4, 2018

(54) GAMING SYSTEM AND METHOD HAVING MATCHING SYMBOL STACKS AND ADDITIONAL AWARD OPPORTUNITIES

(71) Applicant: IGT, Las Vegas, NV (US)

(72) Inventors: Troy Zurawski, Phoenix, AZ (US); T. Grant Bolling, Jr., Maryland Heights, MO (US); Brant Frazee, Scottsdale, AZ (US)

(73) Assignee: IGT, Las Vegas, NV (US)

( * ) Notice: Subject to any disclaimer, the term of this patent is extended or adjusted under 35 U.S.C. 154(b) by 530 days.

(21) Appl. No.: 14/340,165

(22) Filed: Jul. 24, 2014

(65) Prior Publication Data

US 2016/0027238 A1 Jan. 28, 2016

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/326* (2013.01); *G07F 17/3244* (2013.01)

(58) Field of Classification Search

CPC ..... G07F 17/34; G07F 17/3244; G07F 17/326
See application file for complete search history.

(56) References Cited

U.S. PATENT DOCUMENTS

| | | | |
|---|---|---|---|
| 1,564,746 | A | 12/1925 | Barnard |
| 2,692,074 | A | 10/1954 | Mueller et al. |
| 3,810,628 | A | 5/1974 | Vigan |
| 3,889,444 | A | 6/1975 | Davis et al. |
| 3,977,681 | A | 8/1976 | Deitrich |
| 4,099,722 | A | 7/1978 | Rodesch et al. |
| 4,114,890 | A | 9/1978 | Yamamoto et al. |
| 4,171,814 | A | 10/1979 | Tamano |
| 4,198,052 | A | 4/1980 | Gauselmann |
| 4,200,291 | A | 4/1980 | Hooker |
| 4,448,419 | A | 5/1984 | Teinaes |
| 4,573,681 | A | 3/1986 | Okada |
| 4,624,459 | A | 11/1986 | Kaufman |
| 4,636,951 | A | 1/1987 | Harlick |
| 4,648,600 | A | 3/1987 | Olliges |
| 4,651,996 | A | 3/1987 | Watkins, Jr. |
| 4,669,731 | A | 6/1987 | Clarke |
| 4,695,053 | A | 9/1987 | Vazquez, Jr. et al. |

(Continued)

FOREIGN PATENT DOCUMENTS

| | | |
|---|---|---|
| AU | 564351 | 9/1987 |
| AU | 199717601 | 9/1997 |

(Continued)

*Primary Examiner* — Dmitry Suhol
*Assistant Examiner* — Carl V Larsen
(74) *Attorney, Agent, or Firm* — Neal, Gerber & Eisenberg LLP

(57) ABSTRACT

A gaming system which employs a plurality of randomly generated stacks of symbols, wherein a stack of symbols includes a plurality of related symbols positioned adjacent to each other. If a symbol stack modification event occurs, the gaming system modifies a plurality of such symbols not included in any stack of symbols into a stack of symbols. The gaming system then evaluates the displayed symbols (including this newly formed stack of symbols) for any additional awards to provide to the player.

34 Claims, 11 Drawing Sheets

(56) References Cited

U.S. PATENT DOCUMENTS 4,700,948 A 10/1987 Okada
4,722,527 A 2/1988 Gauselmann
4,823,538 A 4/1989 Takamura
4,838,552 A 6/1989 Hagiwara
4,991,848 A 2/1991 Greenwood et al.
5,152,529 A 10/1992 Okada
5,205,555 A 4/1993 Hamano
RE34,244 E 5/1993 Hagiwara
5,219,167 A 6/1993 Hamano
5,224,706 A 7/1993 Bridgeman et al.
5,308,065 A 5/1994 Bridgeman et al.
5,332,219 A 7/1994 Marnell et al.
5,332,228 A 7/1994 Schultz
5,393,057 A 2/1995 Marnell, II
5,393,061 A 2/1995 Manship et al.
5,395,111 A 3/1995 Inoue
5,407,200 A 4/1995 Zalabak
5,423,539 A 6/1995 Nagao
5,431,408 A 7/1995 Adams
5,449,173 A 9/1995 Thomas et al.
5,456,465 A 10/1995 Durham
5,531,440 A 7/1996 Dabrowski et al.
5,560,603 A 10/1996 Seeling et al.
5,564,700 A 10/1996 Celona
5,580,053 A 12/1996 Crouch
5,580,055 A 12/1996 Hagiwara
5,584,764 A 12/1996 Inoue
5,609,524 A 3/1997 Inoue
5,611,535 A 3/1997 Tiberio
5,624,119 A 4/1997 Leake
5,632,485 A 5/1997 Woodland et al.
5,704,835 A 1/1998 Dietz, II
5,711,525 A 1/1998 Breeding
5,720,662 A 2/1998 Holmes, Jr. et al.
5,722,891 A 3/1998 Inoue
5,752,881 A 5/1998 Inoue
5,766,074 A 6/1998 Cannon et al.
5,769,716 A 6/1998 Saffari et al.
5,772,506 A 6/1998 Marks et al.
5,779,544 A 7/1998 Seeling et al.
5,788,573 A 8/1998 Baerlocher et al.
5,807,172 A 9/1998 Piechowiak
5,823,873 A 10/1998 Moody
5,823,874 A 10/1998 Adams
5,833,238 A 11/1998 Watanabe
5,833,536 A 11/1998 Davids et al.
5,833,537 A 11/1998 Barrie
5,848,932 A 12/1998 Adams
5,851,148 A 12/1998 Brune et al.
5,855,514 A 1/1999 Kamille
5,863,249 A 1/1999 Inoue
5,882,261 A 3/1999 Adams
5,890,962 A 4/1999 Takemoto
5,911,418 A 6/1999 Adams
5,918,880 A 7/1999 Voigt, IV et al.
5,919,088 A 7/1999 Weiss
5,927,714 A 7/1999 Kaplan
5,931,467 A 8/1999 Kamille
5,934,672 A 8/1999 Sines et al.
5,935,002 A 8/1999 Falciglia
5,947,820 A 9/1999 Morro et al.
5,951,397 A 9/1999 Dickinson
5,953,127 A 9/1999 Washio et al.
5,964,463 A 10/1999 Moore, Jr.
5,971,849 A 10/1999 Falciglia
5,976,016 A 11/1999 Moody et al.
5,980,384 A 11/1999 Barrie
5,984,781 A 11/1999 Sunaga
5,984,782 A 11/1999 Inoue
5,988,638 A 11/1999 Rodesch et al.
6,003,867 A 12/1999 Rodesch et al.
6,004,207 A 12/1999 Wilson, Jr. et al.
6,007,066 A 12/1999 Moody
6,012,982 A 1/2000 Piechowiak et al.
6,015,346 A 1/2000 Bennett
6,027,115 A 2/2000 Griswold et al.
6,033,307 A 3/2000 Vancura
6,047,963 A 4/2000 Pierce et al.
6,056,642 A 5/2000 Bennett
6,059,658 A 5/2000 Mangano et al.
6,062,980 A 5/2000 Luciano
6,068,552 A 5/2000 Walker et al.
6,086,066 A 7/2000 Takeuchi et al.
6,089,976 A 7/2000 Schneider et al.
6,089,977 A 7/2000 Bennett
6,089,978 A 7/2000 Adams
6,093,102 A 7/2000 Bennett
6,095,921 A 8/2000 Walker et al.
6,102,400 A 8/2000 Scott et al.
6,102,798 A 8/2000 Bennett
6,110,041 A 8/2000 Walker et al.
6,113,098 A 9/2000 Adams
6,117,013 A 9/2000 Eiba
6,120,031 A 9/2000 Adams
6,120,377 A 9/2000 McGinnis, Sr. et al.
6,120,378 A 9/2000 Moody et al.
6,126,542 A 10/2000 Fier
6,142,872 A 11/2000 Walker et al.
6,142,873 A 11/2000 Weiss et al.
6,142,874 A 11/2000 Kodachi et al.
6,149,521 A 11/2000 Sanduski
6,155,925 A 12/2000 Giobbi et al.
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,165,070 A 12/2000 Nolte et al.
6,168,520 B1 1/2001 Baerlocher et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,179,711 B1 1/2001 Yoseloff
6,183,366 B1 2/2001 Goldberg et al.
6,186,894 B1 2/2001 Mayeroff
6,190,254 B1 2/2001 Bennett
6,190,255 B1 2/2001 Thomas et al.
6,190,256 B1 2/2001 Walker et al.
6,200,217 B1 3/2001 Osawa
6,203,429 B1 3/2001 Demar et al.
6,210,277 B1 4/2001 Stefan
6,220,959 B1 4/2001 Holmes, Jr. et al.
6,224,482 B1 5/2001 Bennett
6,224,483 B1 5/2001 Mayeroff
6,224,484 B1 5/2001 Okuda et al.
6,227,969 B1 5/2001 Yoseloff
6,227,971 B1 5/2001 Weiss
6,231,442 B1 5/2001 Mayeroff
6,231,445 B1 5/2001 Acres
6,234,879 B1 5/2001 Hasegawa et al.
6,234,897 B1 5/2001 Frohm et al.
6,237,916 B1 5/2001 Webb
6,241,607 B1 6/2001 Payne et al.
6,251,013 B1 6/2001 Bennett
6,254,481 B1 7/2001 Jaffe
6,261,128 B1 7/2001 Heim et al.
6,261,177 B1 7/2001 Bennett
6,261,178 B1 7/2001 Bennett
6,270,409 B1 8/2001 Shuster
6,270,411 B1 8/2001 Gura et al.
6,290,600 B1 9/2001 Glasson
6,299,165 B1 10/2001 Nagano
6,299,170 B1 10/2001 Yoseloff
6,302,398 B1 10/2001 Vecchio
6,302,790 B1 10/2001 Brossard
6,305,686 B1 10/2001 Perrie et al.
6,309,299 B1 10/2001 Weiss
6,309,300 B1 10/2001 Glavich
6,311,976 B1 11/2001 Yoseloff et al.
6,312,334 B1 11/2001 Yoseloff
6,315,660 B1 11/2001 DeMar et al.
6,315,663 B1 11/2001 Sakamoto
6,319,124 B1 11/2001 Baerlocher et al.

(56) References Cited

U.S. PATENT DOCUMENTS 6,322,078 B1 11/2001 Adams
6,328,649 B1 12/2001 Randall et al.
6,334,864 B1 1/2002 Amplatz et al.
6,336,860 B1 1/2002 Webb
6,340,158 B2 1/2002 Pierce et al.
6,347,996 B1 2/2002 Gilmore et al.
6,350,199 B1 2/2002 Williams et al.
6,358,144 B1 3/2002 Kaddlic et al.
6,364,766 B1 4/2002 Anderson et al.
6,364,768 B1 4/2002 Acres et al.
6,375,570 B1 4/2002 Poole
6,394,902 B1 5/2002 Glavich et al.
6,398,644 B1 6/2002 Perrie et al.
6,409,602 B1 6/2002 Wilshire et al.
6,413,162 B1 7/2002 Baerlocher et al.
6,416,408 B2 7/2002 Tracy et al.
6,419,579 B1 7/2002 Bennett
6,428,412 B1 8/2002 Anderson et al.
6,439,993 B1 8/2002 O'Halloran
6,439,995 B1 8/2002 Hughs-Baird et al.
6,443,452 B1 9/2002 Brune
6,454,266 B1 9/2002 Breeding et al.
6,464,581 B1 10/2002 Yoseloff et al.
6,471,208 B2 10/2002 Yoseloff et al.
6,481,713 B2 11/2002 Perrie et al.
6,485,367 B1 11/2002 Joshi
6,494,454 B2 12/2002 Adams
6,506,114 B1 1/2003 Estes et al.
6,514,141 B1 2/2003 Kaminkow et al.
6,517,432 B1 2/2003 Jaffe
6,517,433 B2 2/2003 Loose et al.
6,520,856 B1 2/2003 Walker et al.
6,537,150 B1 3/2003 Luciano et al.
6,537,152 B2 3/2003 Seeling et al.
6,544,120 B2 4/2003 Ainsworth
6,547,242 B1 4/2003 Sugiyama et al.
6,551,187 B1 4/2003 Jaffe
6,554,704 B2 4/2003 Nicastro et al.
6,561,900 B1 5/2003 Baerlocher et al.
6,561,904 B2 5/2003 Locke et al.
6,565,433 B1 5/2003 Baerlocher
6,565,436 B1 5/2003 Baerlocher
6,572,472 B1 6/2003 Glavich
6,582,306 B1 6/2003 Kaminkow
6,585,591 B1 7/2003 Baerlocher et al.
6,589,114 B2 7/2003 Rose
6,602,136 B1 8/2003 Baerlocher et al.
6,604,740 B1 8/2003 Singer et al.
6,604,999 B2 8/2003 Ainsworth
6,605,000 B2 8/2003 Adams
6,605,002 B2 8/2003 Baerlocher
6,612,574 B1 9/2003 Cole et al.
6,616,142 B2 9/2003 Adams
6,632,140 B2 10/2003 Berman et al.
6,634,945 B2 10/2003 Glavich et al.
6,638,165 B2 10/2003 Uchlyama et al.
6,641,477 B1 11/2003 Dietz, II
6,644,663 B2 11/2003 Seelig et al.
6,644,664 B2 11/2003 Muir et al.
6,663,487 B1 12/2003 Ladner
6,672,960 B1 1/2004 B-Jensen
6,676,511 B2 1/2004 Payne et al.
6,676,512 B2 1/2004 Fong et al.
6,702,675 B2 3/2004 Poole et al.
6,719,630 B1 4/2004 Seelig et al.
6,726,204 B2 4/2004 Inoue
6,731,313 B1 5/2004 Kaminkow
6,733,389 B2 5/2004 Webb et al.
6,746,328 B2 6/2004 Cannon et al.
6,749,504 B2 6/2004 Hughs-Baird
6,758,473 B2 7/2004 Seelig et al.
6,780,109 B2 8/2004 Kaminkow
6,786,818 B1 9/2004 Rothschild et al.
6,793,578 B2 9/2004 Luccesi et al.
6,805,349 B2 10/2004 Baerlocher et al.
6,805,629 B1 10/2004 Weiss
6,805,632 B2 10/2004 Suda
6,808,454 B2 10/2004 Gerrard et al.
6,817,946 B2 11/2004 Motegi et al.
6,835,133 B2 12/2004 Baerlocher et al.
6,855,054 B2 2/2005 White et al.
6,860,810 B2 3/2005 Cannon et al.
6,869,357 B2 3/2005 Adams et al.
6,880,826 B2 4/2005 Inoue
6,893,018 B2 5/2005 Inoue
6,896,615 B2 5/2005 Berman
6,905,406 B2 6/2005 Kaminkow et al.
6,905,408 B2 6/2005 Inoue
6,908,381 B2 6/2005 Ellis
6,908,390 B2 6/2005 Nguyen et al.
6,910,962 B2 6/2005 Marks et al.
6,916,243 B2 7/2005 Yoshida
6,921,335 B2 7/2005 Rodgers et al.
6,923,441 B2 8/2005 Inoue
6,932,700 B2 8/2005 Bennett et al.
6,942,572 B2 9/2005 Inoue
6,960,133 B1 11/2005 Marks et al.
6,960,134 B2 11/2005 Hartl et al.
6,976,915 B2 12/2005 Baker et al.
6,981,635 B1 1/2006 Hughs-Baird et al.
6,997,808 B2 2/2006 Rodgers et al.
7,001,274 B2 2/2006 Baerlocher et al.
7,014,560 B2 3/2006 Glavich et al.
7,018,293 B2 3/2006 Brown et al.
7,040,987 B2 5/2006 Walker et al.
7,048,275 B2 5/2006 Adams
7,056,213 B2 6/2006 Ching et al.
7,070,502 B1 7/2006 Bussick et al.
7,074,127 B2 7/2006 Cuddy et al.
7,077,744 B2 7/2006 Cannon
7,077,745 B2 7/2006 Gomez et al.
7,090,580 B2 8/2006 Rodgers et al.
7,094,148 B2 8/2006 Baerlocher et al.
7,137,888 B2 11/2006 Glavich et al.
7,144,322 B2 12/2006 Gomez et al.
7,160,187 B2 1/2007 Loose et al.
7,168,704 B1 1/2007 Lawless
7,169,042 B2 1/2007 Muir et al.
7,179,166 B1 2/2007 Abbott
7,204,753 B2 4/2007 Ozaki et al.
7,214,132 B2 5/2007 Inoue
7,226,359 B2 6/2007 Bussick et al.
7,237,775 B2 7/2007 Thomas et al.
7,252,589 B1 8/2007 Marks et al.
7,252,591 B2 8/2007 Van Asdale
7,252,592 B2 8/2007 Rodgers et al.
7,258,611 B2 8/2007 Bigelow, Jr. et al.
7,275,988 B2 10/2007 Aida et al.
7,311,602 B2 12/2007 Inoue
7,311,607 B2 12/2007 Tedsen et al.
7,316,395 B1 1/2008 Kromydas
7,381,134 B2 6/2008 Cuddy et al.
7,396,279 B2 7/2008 Berman et al.
7,399,225 B2 7/2008 Kaminkow
7,442,123 B2 10/2008 Brill et al.
7,479,061 B2 1/2009 Okada
7,481,709 B2 1/2009 Bussick et al.
7,597,618 B2 10/2009 Webb et al.
7,690,984 B2 4/2010 Tran et al.
7,699,698 B2 4/2010 Randall
7,780,519 B2 8/2010 Gomez
7,824,262 B2 11/2010 Webb et al.
7,950,994 B2 5/2011 Berman et al.
8,002,626 B2 8/2011 Englman
8,096,869 B2 1/2012 Yoshimi
8,096,877 B2 1/2012 Hoffman
8,241,107 B2 8/2012 Moroney
8,272,946 B2 9/2012 Cuddy et al.
8,366,540 B2 2/2013 Yoshimi
8,414,380 B2 4/2013 Saunders et al.
8,460,094 B2 6/2013 Bigelow, Jr. et al.
8,529,333 B2 9/2013 Berman et al.
8,574,059 B2 11/2013 Rodgers et al.
8,585,487 B2 11/2013 Rodgers et al.

(56) References Cited

U.S. PATENT DOCUMENTS 8,616,955 B2 12/2013 Yoshimi
8,622,810 B2 1/2014 Yoshimi
8,628,401 B2 1/2014 Yoshimi
8,641,508 B2 2/2014 Yoshimi
9,262,893 B2 2/2016 Berman et al.
2001/0009865 A1 7/2001 Demar et al.
2001/0019965 A1 9/2001 Ochi
2002/0010017 A1 1/2002 Bennett
2002/0020965 A1 2/2002 Potter et al.
2002/0039920 A1 4/2002 Bryant
2002/0055382 A1 5/2002 Meyer
2002/0068623 A1 6/2002 Gauselmann
2002/0077165 A1 6/2002 Bansemer et al.
2002/0086725 A1 7/2002 Fasbender et al.
2002/0115488 A1 8/2002 Berry et al.
2002/0123378 A1 9/2002 Bucknall et al.
2002/0142825 A1 10/2002 Lark et al.
2002/0142846 A1 10/2002 Paulsen
2002/0155881 A1 10/2002 Yoshida
2002/0160836 A1 10/2002 Watanabe et al.
2002/0175466 A1 11/2002 Loose et al.
2002/0196342 A1 12/2002 Walker et al.
2003/0013517 A1 1/2003 Bennett et al.
2003/0022712 A1 1/2003 Locke
2003/0022713 A1 1/2003 Jasper et al.
2003/0027611 A1 2/2003 Recard
2003/0027623 A1 2/2003 Rose
2003/0027626 A1 2/2003 Marks et al.
2003/0032470 A1 2/2003 Weiss et al.
2003/0036422 A1 2/2003 Baerlocher et al.
2003/0045354 A1 3/2003 Giobbi
2003/0054872 A1 3/2003 Locke et al.
2003/0054874 A1 3/2003 Kaminkow
2003/0057645 A1 3/2003 Baerlocher et al.
2003/0060267 A1 3/2003 Glavich et al.
2003/0064768 A1 4/2003 Fier
2003/0064779 A1 4/2003 Suda
2003/0064796 A1 4/2003 Glavich et al.
2003/0064797 A1 4/2003 Jackson et al.
2003/0064800 A1 4/2003 Jackson et al.
2003/0069062 A1 4/2003 Shimizu
2003/0083121 A1 5/2003 Cole et al.
2003/0087687 A1 5/2003 Locke et al.
2003/0092480 A1 5/2003 White et al.
2003/0100356 A1 5/2003 Brown et al.
2003/0119579 A1 6/2003 Walker et al.
2003/0125100 A1 7/2003 Cannon
2003/0134673 A1 7/2003 Moody
2003/0153382 A1 8/2003 Vancura
2003/0162585 A1 8/2003 Bigelow, Jr. et al.
2003/0190947 A1 10/2003 Baerlocher et al.
2003/0190948 A1 10/2003 Baerlocher et al.
2003/0203752 A1 10/2003 Kaminkow et al.
2003/0203753 A1 10/2003 Muir et al.
2003/0216165 A1 11/2003 Singer et al.
2003/0216169 A1 11/2003 Walker et al.
2003/0220134 A1 11/2003 Walker et al.
2004/0012145 A1 1/2004 Inoue
2004/0014516 A1 1/2004 Inoue
2004/0014517 A1 1/2004 Inoue
2004/0017041 A1 1/2004 Inoue
2004/0026854 A1 2/2004 Inoue
2004/0033827 A1 2/2004 Gilmore et al.
2004/0033829 A1 2/2004 Pacey et al.
2004/0036218 A1 2/2004 Inoue
2004/0038726 A1 2/2004 Inoue
2004/0048646 A1 3/2004 Visocnik
2004/0048650 A1 3/2004 Minerau et al.
2004/0051239 A1 3/2004 Seelig et al.
2004/0053676 A1 3/2004 Rodgers et al.
2004/0053679 A1 3/2004 Getz et al.
2004/0053683 A1 3/2004 Hartl et al.
2004/0058722 A1 3/2004 Yang et al.
2004/0058727 A1 3/2004 Marks et al.
2004/0063488 A1 4/2004 Berman
2004/0072610 A1 4/2004 White et al.
2004/0082378 A1 4/2004 Peterson et al.
2004/0092299 A1 5/2004 Gauselmann
2004/0092300 A1 5/2004 Gauselmann
2004/0100025 A1 5/2004 Conklin et al.
2004/0116175 A1 6/2004 Aida
2004/0137982 A1 7/2004 Cuddy et al.
2004/0192431 A1 9/2004 Singer et al.
2004/0195773 A1 10/2004 Masci et al.
2004/0198486 A1 10/2004 Walker et al.
2004/0219968 A1 11/2004 Fiden et al.
2004/0219969 A1 11/2004 Casey et al.
2004/0242313 A1 12/2004 Munoz
2004/0242316 A1 12/2004 Oles et al.
2004/0259631 A1 12/2004 Katz et al.
2004/0266507 A1 12/2004 Cooper
2004/0266520 A1 12/2004 Aida
2005/0009597 A1 1/2005 Daly
2005/0026673 A1 2/2005 Paulsen et al.
2005/0043083 A1 2/2005 Inoue
2005/0043084 A1 2/2005 Inoue
2005/0049035 A1 3/2005 Baerlocher et al.
2005/0054405 A1 3/2005 Baerlocher et al.
2005/0054412 A1 3/2005 Gauselmann
2005/0054418 A1 3/2005 Baerlocher et al.
2005/0059477 A1 3/2005 Baerlocher
2005/0059478 A1 3/2005 Peterson et al.
2005/0064924 A1 3/2005 Glavich et al.
2005/0096113 A1 5/2005 Gabuchian
2005/0130731 A1 6/2005 Englman et al.
2005/0130737 A1 6/2005 Englman et al.
2005/0148384 A1 7/2005 Marks et al.
2005/0159208 A1 7/2005 Pacey
2005/0192081 A1 9/2005 Marks et al.
2005/0197182 A1 9/2005 Duhamel
2005/0227754 A1 10/2005 Kaminkow et al.
2005/0277460 A1 12/2005 Inoue
2005/0282620 A1 12/2005 Marks et al.
2005/0288094 A1 12/2005 Marks et al.
2006/0019738 A1 1/2006 Baerlocher et al.
2006/0025210 A1 2/2006 Johnson
2006/0030392 A1 2/2006 Rodgers et al.
2006/0040728 A1 2/2006 Fuller
2006/0046830 A1 3/2006 Webb
2006/0052155 A1 3/2006 Inoue
2006/0058097 A1 3/2006 Berman et al.
2006/0068875 A1 3/2006 Cregan et al.
2006/0068884 A1 3/2006 Baerlocher et al.
2006/0068885 A1 3/2006 Cregan et al.
2006/0068892 A1 3/2006 Gomez
2006/0073872 A1 4/2006 B-Jensen et al.
2006/0073879 A1 4/2006 Baerlocher
2006/0084492 A1 4/2006 Baerlocher et al.
2006/0084494 A1 4/2006 Belger et al.
2006/0084498 A1 4/2006 Baerlocher et al.
2006/0089191 A1 4/2006 Singer et al.
2006/0111174 A1 5/2006 Baerlocher et al.
2006/0116195 A1 6/2006 Baerlocher et al.
2006/0135247 A1 6/2006 Baerlocher et al.
2006/0154717 A1 7/2006 Jackson
2006/0166731 A1 7/2006 Yoshimi et al.
2006/0172795 A1 8/2006 Bussick et al.
2006/0183533 A1 8/2006 Tran et al.
2006/0183534 A1 8/2006 Yoshimi
2006/0189377 A1 8/2006 Gomez
2006/0199636 A1 9/2006 Ching et al.
2006/0199637 A1 9/2006 Ching et al.
2006/0211484 A1 9/2006 Hornik et al.
2006/0247002 A1 11/2006 Yoshimi et al.
2006/0287060 A1 12/2006 Yoshimi
2007/0004489 A1 1/2007 Rodgers et al.
2007/0010316 A1 1/2007 Baerlocher et al.
2007/0015565 A1 1/2007 Chan
2007/0021175 A1 1/2007 Rodgers et al.
2007/0021188 A1 1/2007 Rodgers et al.
2007/0060246 A1 3/2007 Baerlocher et al.
2007/0060248 A1 3/2007 Rodgers et al.
2007/0060294 A1 3/2007 Cuddy et al.
2007/0087812 A1 4/2007 Glavich et al.

(56) References Cited

U.S. PATENT DOCUMENTS

| | | | | |
|---|---|---|---|---|
| 2007/0155474 | A1 | 7/2007 | Gauselmann | |
| 2007/0270203 | A1 | 11/2007 | Aida | |
| 2008/0045300 | A1 | 2/2008 | Quayle et al. | |
| 2008/0045309 | A1 | 2/2008 | Okada | |
| 2008/0045323 | A1 | 2/2008 | Berman | |
| 2008/0108409 | A1 | 5/2008 | Cole et al. | |
| 2008/0113735 | A1 | 5/2008 | Maya | |
| 2008/0139298 | A1 | 6/2008 | Rodgers et al. | |
| 2008/0182644 | A1 | 7/2008 | Lutnick et al. | |
| 2008/0200232 | A1 | 8/2008 | Baerlocher et al. | |
| 2009/0017989 | A1 | 1/2009 | Karlsson | |
| 2009/0082087 | A1 | 3/2009 | Pacey et al. | |
| 2009/0118004 | A1 | 5/2009 | Hoffman | |
| 2009/0124342 | A1 | 5/2009 | Fong | |
| 2009/0124347 | A1* | 5/2009 | Rodgers | G07F 17/34 463/21 |
| 2009/0227332 | A1 | 9/2009 | Yoshizawa | |
| 2009/0227337 | A1 | 9/2009 | Langille et al. | |
| 2009/0286592 | A1 | 11/2009 | Vann | |
| 2010/0273550 | A1 | 10/2010 | Marks et al. | |
| 2011/0130193 | A1 | 6/2011 | Belger et al. | |
| 2012/0083327 | A1 | 4/2012 | Zobel et al. | |
| 2012/0172106 | A1* | 7/2012 | Caputo | G07F 17/34 463/20 |
| 2013/0217463 | A1 | 8/2013 | Hughes et al. | |
| 2014/0057698 | A1 | 2/2014 | Rodgers et al. | |
| 2014/0066174 | A1 | 3/2014 | Rodgers et al. | |
| 2014/0274294 | A1 | 9/2014 | Baerlocher et al. | |
| 2015/0119129 | A1* | 4/2015 | Igesund | G07F 17/3213 463/20 |

FOREIGN PATENT DOCUMENTS

| | | |
|---|---|---|
| AU | 199917318 | 9/1999 |
| AU | 722969 | 8/2000 |
| AU | 768153 | 12/2003 |
| AU | 2004203045 | 7/2004 |
| AU | 2002301067 | 6/2007 |
| EP | 0058488 | 8/1982 |
| EP | 0373801 | 12/1988 |
| EP | 0410789 | 2/1990 |
| EP | 0737494 | 10/1996 |
| EP | 0874337 | 10/1998 |
| EP | 0984408 | 3/2000 |
| EP | 1039424 | 9/2000 |
| EP | 1063622 | 12/2000 |
| EP | 1513117 | 3/2005 |
| EP | 1544811 | 6/2005 |
| GB | 869755 | 6/1961 |
| GB | 1298681 | 12/1972 |
| GB | 1454046 | 10/1976 |
| GB | 1568522 | 5/1980 |
| GB | 2062922 | 5/1981 |
| GB | 2062923 | 5/1981 |
| GB | 2106293 | 9/1981 |
| GB | 2097160 | 10/1982 |
| GB | 2106295 | 4/1983 |
| GB | 2117155 | 10/1983 |
| GB | 2117952 | 10/1983 |
| GB | 2130413 | 5/1984 |
| GB | 2156565 | 10/1985 |
| GB | 2157047 | 10/1985 |
| GB | 2160345 | 12/1985 |
| GB | 2165074 | 4/1986 |
| GB | 2165385 | 4/1986 |
| GB | 2170636 | 8/1986 |
| GB | 2182476 | 5/1987 |
| GB | 2226907 | 7/1990 |
| GB | 2242300 | 9/1991 |
| GB | 2243236 | 10/1991 |
| GB | 2322217 | 8/1998 |
| GB | 2353128 | 2/2001 |
| GB | 2372132 | 2/2001 |
| GB | 2372617 | 8/2002 |
| GB | 2384097 | 7/2003 |
| JP | 2003290493 | 10/2003 |
| JP | 2004081341 | 3/2004 |
| JP | 2004249002 | 9/2004 |
| JP | 2004249003 | 9/2004 |
| WO | WO 9719736 | 6/1997 |
| WO | WO 9727569 | 7/1997 |
| WO | WO 9732285 | 9/1997 |
| WO | WO 9820949 | 5/1998 |
| WO | WO 0030727 | 6/2000 |
| WO | WO 0032286 | 6/2000 |
| WO | WO 0066235 | 11/2000 |
| WO | WO 0076606 | 12/2000 |
| WO | WO 0115055 | 3/2001 |
| WO | WO 0126019 | 4/2001 |
| WO | WO 0133478 | 5/2001 |
| WO | WO 02054331 | 7/2002 |
| WO | WO 03089084 | 10/2003 |
| WO | WO 2005010831 | 2/2005 |
| WO | WO 2005009560 | 3/2005 |
| WO | WO 2007053349 | 5/2007 |

* cited by examiner

GAMING SYSTEM AND METHOD HAVING MATCHING SYMBOL STACKS AND ADDITIONAL AWARD OPPORTUNITIES

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate a primary or base game. In many of these gaming machines, the award for each played primary game is based on the player obtaining a winning symbol or symbol combination and on the amount of the wager placed on that primary game (e.g., the higher the wager, the higher the award). Generally, symbols or symbol combinations which are less likely to occur usually provide higher awards.

Certain known gaming machines include a plurality of reels. Each reel includes a plurality of symbols. After a player places a wager on the game, the reels spin and then stop to display a generated combination of symbols on the reels. If a winning symbol or winning combination of symbols is/are generated along an active payline associated with the reels (or in a scatter pay configuration), the player receives the award associated with the generated winning symbol or generated winning combination of symbols.

Symbol stacking in a reel game is also known. Symbol stacking is implemented by forming stacks of one or more identical symbols in adjacent symbol positions of a reel strip utilized by a single reel. The identical symbols on the same single reel are adjacent to each other, and thus "stacked." For example, in a slot game with three rows of symbols, three cherry symbols may appear adjacent to each other on a reel to form a stack of three cherry symbols. For a spin of the stacked reel of such a slot game, part or all of a stack of symbols can be displayed in a viewing area of the gaming machine. In one known slot gaming device, when a gaming machine generates stacks of symbols that are identical on three or more adjacent reels, multiple winning symbol combinations can be formed and the gaming machine can provide large payouts to the player if portions of one or more stacks of symbols are displayed.

Using such stacked symbols in a reel gaming machine may create a problem when stacks of symbols are not generated on adjacent reels. A gaming machine may generate stacks of identical symbols on two non-adjacent reels. That is, if stacks of identical symbols are generated on two non-adjacent reels which are separated by one or more reels that generated symbols different than the stacks of symbols, a winning combination of symbols cannot be formed from what appeared to be an impressive generation of symbols. Often times players receive many stacks of symbols but no winning symbol combinations.

There is a continuing need to increase the excitement and entertainment experienced by people playing gaming machines which utilize stacks of symbols. There is a further need for increasing the number of winning symbol combinations generated and awards provided to a player for a single play of a game.

SUMMARY

The present disclosure relates generally to gaming systems and methods having matching symbol stacks and additional award opportunities.

In various embodiments, the gaming system disclosed herein employs a plurality of randomly generated symbols which form zero, one or more stacks of symbols including a plurality of related symbols (e.g., identical symbols) positioned adjacent to each other on a reel or reel strip. In these embodiments, if a symbol stack modification event occurs, the gaming system modifies a plurality of such symbols not included in any stack of symbols into a stack of symbols. That is, upon an occurrence of a symbol stack modification event, such as the generation of two stacks of symbols associated with non-adjacent reels, the gaming system converts or modifies a plurality of symbols into related symbols (e.g., identical symbols) to form another stack of symbols on that reel or reel strip. The gaming system then evaluates the displayed symbols (including this newly formed stack of symbols) for any additional awards to provide to the player. Such a configuration thus increases the level of excitement and enjoyment for certain players by providing an opportunity to form a large number of winning symbol combinations associated with a large number of awards.

More specifically, in various embodiments, for a play of a game, the gaming system employs a plurality of reels, wherein in addition to a plurality of non-stacked symbols, two or more of the reels each include a plurality of symbols arranged to form a stack of symbols. For example, one reel includes four apple symbols at three adjacent reel stop positions and the remaining symbols are non-stacked symbols, and another reel includes four apple symbols at three adjacent reel stop positions and the remaining symbols are non-stacked symbols.

In operation of these embodiments, the gaming system utilizes the plurality of reels to randomly determine and display a plurality of symbols at a plurality of symbol display positions. Zero, one or more of such plurality of symbols at zero, one or more adjacent symbol display positions are displayed as zero, one or more stacks of identical symbols. For example, the gaming system causes: (i) a first reel associated with a first set of symbol display positions to display a stack of three apple symbols, (ii) a second reel associated with a second set of symbol display positions to display a cherry symbol, a bell symbol and a banana symbol, and (iii) a third reel associated with a third set of symbol display positions to display a stack of three apple symbols.

After displaying the plurality of symbols, the gaming system of these embodiments determines and displays any awards associated with the randomly displayed symbols. Continuing with the example above, the gaming system determines that the displayed symbols form no winning symbol combinations and thus the displayed symbols are not associated with any awards.

In addition to determining any awards associated with these displayed symbols, the gaming system determines if a symbol stack modification event occurred. In one such embodiment, a stacked symbol modification event includes the display of at least two stacks of symbols associated with at least two non-adjacent reels. In one such embodiment, the gaming system determines if a plurality of symbol display positions associated with at least two non-adjacent reels each display a stack of symbols by displaying a plurality of identical symbols adjacent to each other. In another such embodiment, the gaming system determines if each of the symbol display positions associated with at least two non-adjacent reels each display a stack of symbols by displaying a plurality of identical symbols adjacent to each other. Utilizing the above example, the gaming system determines that a symbol stack modification event occurred because the gaming system displayed a stack of apple symbols at each of: (i) the first set of symbol display positions associated with the first reel and (ii) the third set of symbol display positions associated with the third reel (which is not adjacent to the first reel).

In these embodiments, if no symbol stack modification event occurred, the gaming system concludes the play of the game and awaits another play of the game. On the other hand, if a symbol stack modification event occurred, the gaming system selects at least one of the reels which does not display a stack of symbols. In one such embodiment, the gaming system selects at least one of the reels that does not display a stack of symbols and is between the two non-adjacent reels that each display a stack of symbols. In another such embodiment, the gaming system selects each of the reels that does not display a stack of symbols.

After selecting one or more reels, the gaming system modifies one, more or each of the symbols displayed at the symbol display positions associated with the selected reel to a designated symbol. In one such embodiment, the designated symbol is a predetermined symbol. In another such embodiment, the designated symbol is a randomly selected symbol. Continuing with the example above, following the occurrence of the symbol stack modification event, the gaming system modified each of the symbols displayed at the second set of symbol display positions associated with the second reel to apple symbols.

After the modification of one or more symbols displayed at one or more symbol display positions, the gaming system again determines and displays any awards associated with the displayed symbols. Continuing with the example above, the gaming system determines that the displayed symbols form one or more winning symbol combinations and thus the displayed symbols are now associated with one or more awards. As seen in this example, based on the occurrence of the symbol stack modification event, the gaming system modified the previously displayed losing symbol combinations (not associated with any awards) to winning symbol combinations (associated with awards).

Such a configuration thus increases the level of player excitement and enjoyment by providing an opportunity to form a large number of winning symbol combinations, even though the symbol display positions of adjacent reels did not initially display stacks of identical symbols.

Additional features and advantages are described herein, and will be apparent from the following Detailed Description and the figures.

DETAILED DESCRIPTION

Symbol Stacks

In various embodiments, the gaming system disclosed herein employs a plurality of randomly generated symbols which form zero, one or more stacks of symbols including a plurality of related symbols (e.g., identical symbols) positioned adjacent to each other on a reel or reel strip. In these embodiments, if a symbol stack modification event occurs, the gaming system modifies a plurality of such symbols not included in any stack of symbols into a stack of symbols. That is, upon an occurrence of a symbol stack modification event, such as the generation of two stacks of symbols associated with non-adjacent reels, the gaming system converts or modifies a plurality of symbols into related symbols (e.g., identical symbols) to form another stack of symbols on that reel or reel strip. The gaming system then evaluates the displayed symbols (including this newly formed stack of symbols) for any additional awards to provide to the player. Such a configuration thus increases the level of excitement and enjoyment for certain players by providing an opportunity to form a large number of winning symbol combinations associated with a large number of awards.

While certain of the embodiments described below are directed to modifying one or more non-stack of symbols to one or more stacks of symbols in association with a play of a primary or base game, it should be appreciated that the present disclosure may additionally or alternatively be employed in association with modifying one or more non-stack of symbols to one or more stacks of symbols in association with a play of a secondary or bonus game. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

Figure 1:
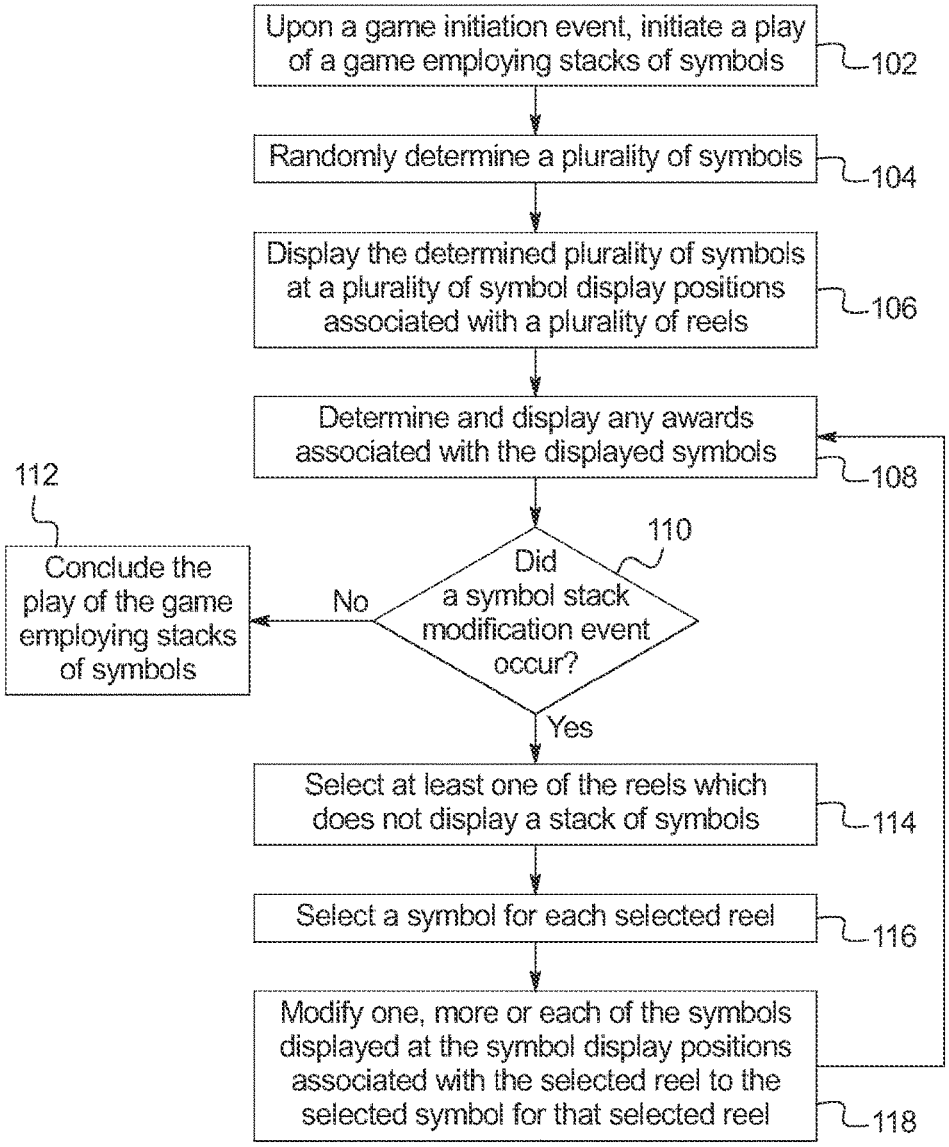
FIG. 1 is a flow chart of an example process for operating a gaming system disclosed herein including modifying one or more non-stacked symbols to a stack of symbols.

Referring now to FIG. 1, a flowchart of an example embodiment of a process for operating a gaming system disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In one embodiment, as indicated in block 102, upon a game initiation event, the gaming system initiates a play of a game employing stacks of symbols.

In one embodiment wherein the game is a primary game, the game initiation event occurs upon the player placing a wager to play the game. In another embodiment wherein the game is a secondary game, the gaming system causes a game initiation event to occur independent of any displayed events associated with any plays of any games. In another embodiment wherein the game is a secondary game, the gaming system causes a game initiation event to occur based on (or as a result of) one or more displayed events occurring in association with one or more plays of one or more games. In another embodiment wherein the game is a secondary game, the gaming system tracks the occurrences of one or more suitable events occurring at or in association with one or more players and/or one or more games and determines, based on these tracked events, whether a game initiation event occurs. In another embodiment wherein the game is a secondary game, the gaming system defines one or more game play parameters, such as a wager amount or a maximum wager amount, wherein the gaming system determines whether a game initiation event occurs based on a player's tracked game play activity satisfying the defined parameter.

In various embodiments, each reel includes a plurality of reel positions and a plurality of symbols displayed at the reel positions. At least two of the reels each include at least one stack of symbols, wherein a stack of symbols is formed by arranging a plurality of identical symbols adjacent to each other on the same reel.

For the initiated play of the game, the gaming system randomly determines a plurality of symbols as indicated in block 104. The gaming system then displays the determined plurality of symbols at a plurality of symbol display positions associated with a plurality of reels as indicated in block 106.

Figure 2A:
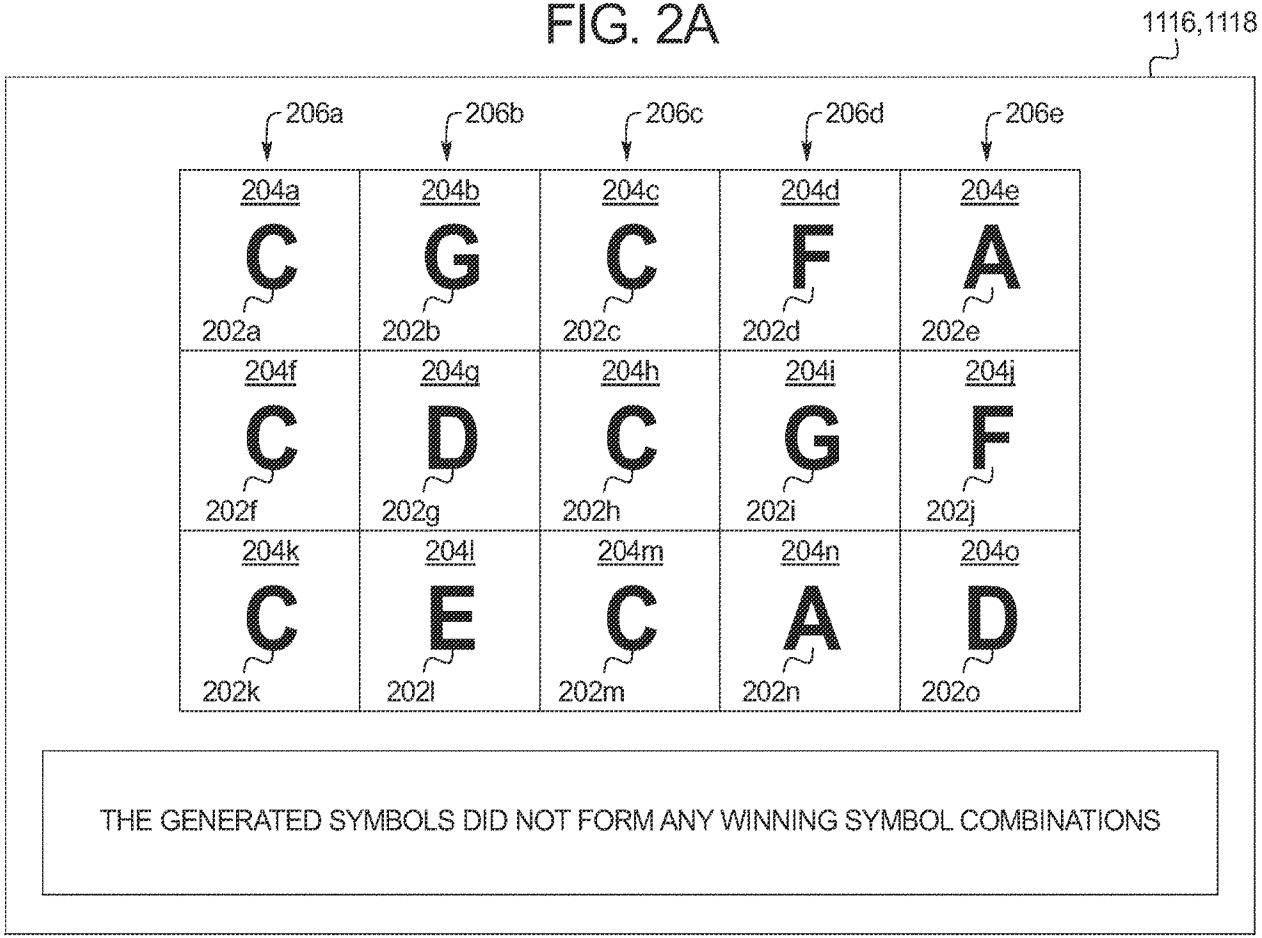
FIGS. 2A, 2B, 2C and 2D are front views of one embodiment of the gaming system disclosed herein illustrating a modification of a stack of non-identical symbols to a stack of identical symbol.

For example, as seen in FIG. 2A, the gaming system determined and displayed a plurality of symbol 202 at a plurality of symbol display positions 204 associated with the plurality of reels 206. Specifically: (a) for a first reel 206*a*, the gaming system displayed: (i) a C symbol 202*a* at symbol display position 204*a*, (ii) a C symbol 202*f* at symbol display position 204*f*, and (iii) a C symbol 202*k* at symbol display position 204*k*; (b) for a second reel 206*b*, the gaming system displayed: (i) a G symbol 202*b* at symbol display position 204*b*, (ii) a D symbol 202*g* at symbol display position 204*g*, and (iii) an E symbol 202*l* at symbol display position 204*l*; (c) for a third reel 206*c*, the gaming system displayed: (i) a C symbol 202*c* at symbol display position 204*c*, (ii) a C symbol 202*h* at symbol display position 204*h*, and (iii) a C symbol 202*m* at symbol display position 204*m*; (d) for a fourth reel 206*d*, the gaming system displayed: (i) a F symbol 202*d* at symbol display position 204*d*, (ii) a G symbol 202*i* at symbol display position 204*i*, and (iii) an A symbol 202*n* at symbol display position 204*n*; and (e) for a fifth reel 206*e*, the gaming system displayed: (i) an A symbol 202*e* at symbol display position 204*e*, (ii) an F symbol 202*j* at symbol display position 204*j*, and (iii) a D symbol 202*o* at symbol display position 204*o*.

As seen in FIG. 2A, this random determination and display of a plurality of symbols resulted in the display of a stack of C symbols at the symbol display positions associated with the first reel and a stack of C symbols at the symbol display positions associated with the third reel.

Following the display of a plurality of symbols at a plurality of symbol display positions, as indicated in block 108 of FIG. 1, the gaming system determines and displays any awards associated with the displayed symbols. For example, as seen in FIG. 2A, the gaming system determined that the displayed symbols are not associated with any awards. In this example, the gaming system provides appropriate messages such as "THE GENERATED SYMBOLS DID NOT FORM ANY WINNING SYMBOL COMBINATIONS" to the player visually, or through suitable audio or audiovisual displays.

After this award evaluation, the gaming system determines if a symbol stack modification event occurred as indicated in diamond 110 of FIG. 1. In various embodiments, the gaming system causes a symbol stack modification event to occur based on (or as a result of) one or more displayed events occurring in association with one or more plays of one or more games. In one embodiment, a stacked symbol modification event occurs if the gaming system displays at least two stacks of symbols associated with at least two non-adjacent reels.

Figure 2B:
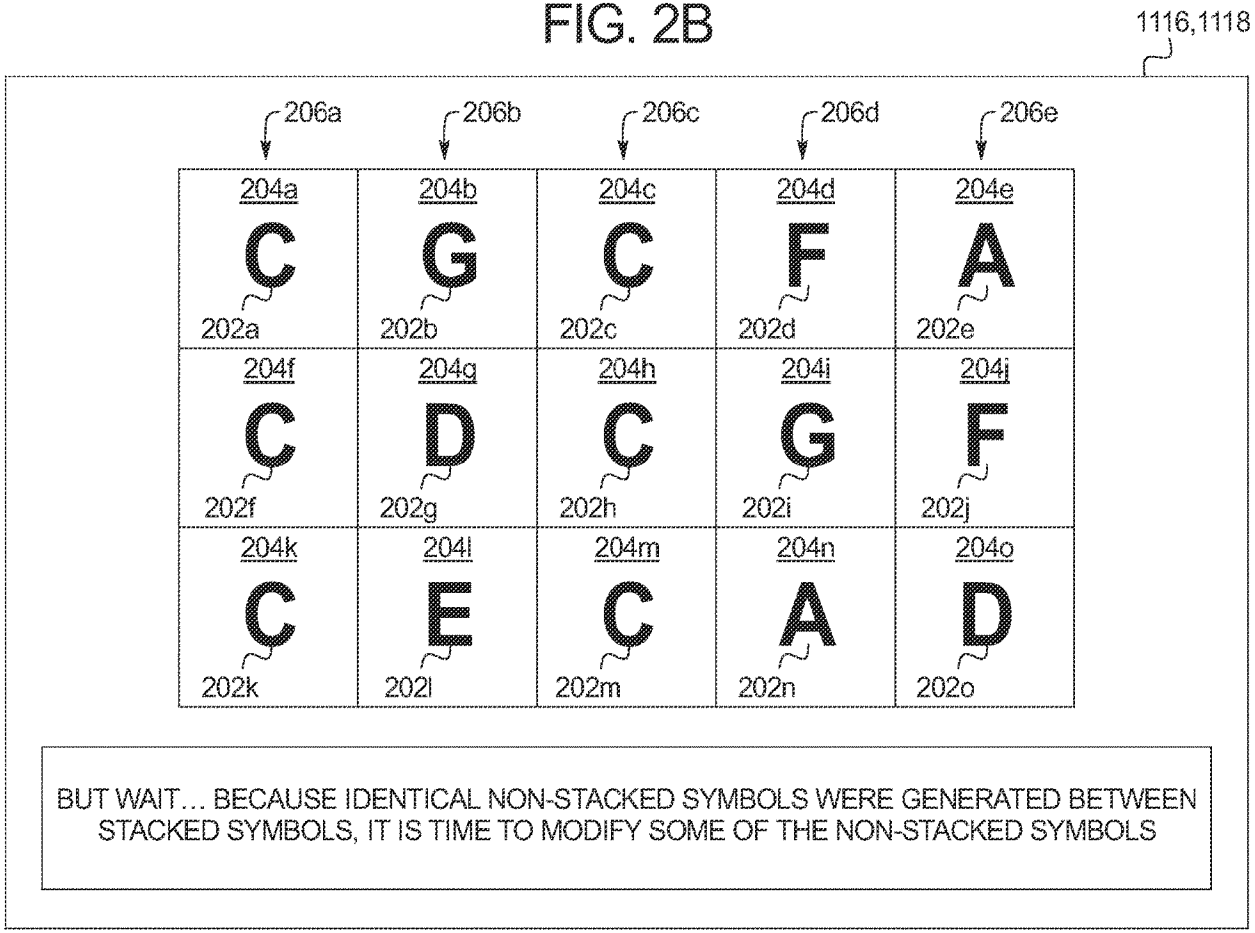

For example, as seen in FIG. 2B, the gaming system determined that (i) the stack of C symbols at the symbol display positions associated with the first reel, (ii) the non-stacked symbols at the symbol display positions associated with the second reel, and (iii) the stack of C symbols at the symbol display positions associated with the third reel resulted in an occurrence of a symbol stack modification event. In this example, the gaming system provides appropriate messages such as "BUT WAIT . . . BECAUSE IDENTICAL NON-STACKED SYMBOLS WERE GENERATED BETWEEN STACKED SYMBOLS, IT IS TIME TO MODIFY SOME OF THE NON-STACKED SYMBOLS" to the player visually, or through suitable audio or audiovisual displays.

Returning to FIG. 1, if the gaming system determines that no symbol stack modification event occurred, the gaming system concludes the play of the game employing stacks of symbols as indicated in block 112.

On the other hand, if the gaming system determines that a symbol stack modification event occurred, as indicated in block 114, the gaming system selects at least one of the reels which does not display a stack of symbols. In one such embodiment, the gaming system selects at least one of the reels that does not display a stack of symbols and is between the two non-adjacent reels that each display a stack of symbols. In another such embodiment, the gaming system selects at least one of the reels that does not display a stack of symbols regardless of if that reel is between the two non-adjacent reels that each display a stack of symbols. In another such embodiment, the gaming system selects each of the reels that does not display a stack of symbols.

After selecting one or more reels, as indicated in block 116, the gaming system selects a symbol for each selected reel. In one embodiment, the gaming system randomly selects any of the available symbols for each selected reel. In another embodiment, the gaming system randomly selects a symbol from a set of symbols for each selected reel. In another embodiment, the gaming system selects a predetermined symbol for each selected reel. In one such embodiment, the predetermined symbol is a bonus symbol. In another such embodiment, the predetermined symbol is a wild symbol. In another embodiment, the predetermined symbol is the same as the symbol forming the stack on one of the other reels.

Following the selection of a symbol, as indicated in block 118, the gaming system modifies one, more or each of the symbols displayed at the symbol display positions associated with the selected reel to the selected symbol for that selected reel. That is, upon the gaming system determining that at least two stacks of identical symbols are separated by at least one set of different symbols, the gaming system modifies two or more of these different symbols to create another stack of identical symbols.

Figure 2C:
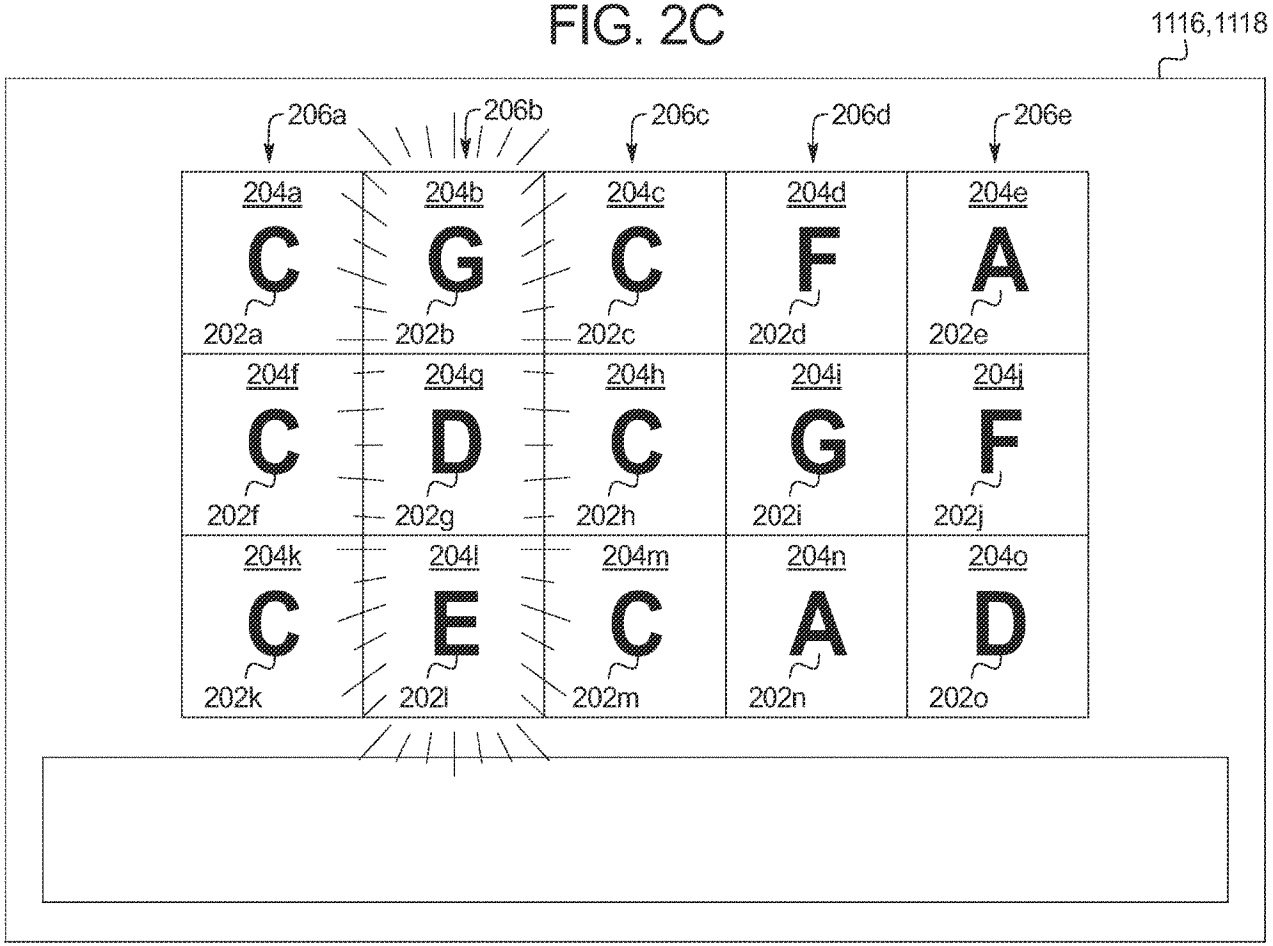
Figure 2D:
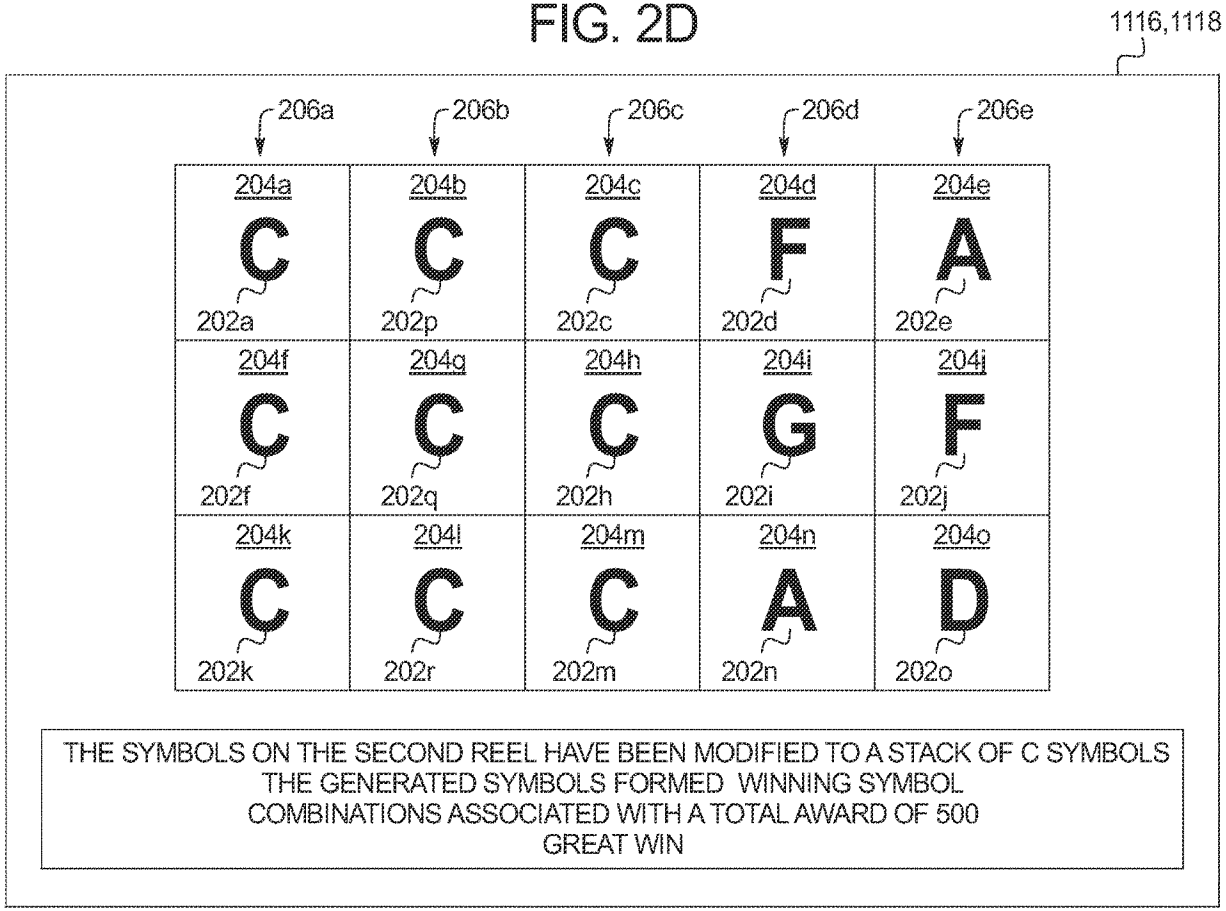

For example, as seen in FIGS. 2C and 2D, after determining that the symbol stack modification event occurred in associated with the identical stacks of symbols on the first and third reels, the gaming system selected the second reel 206*b* and then selected the C symbol. The gaming system then modifies each of the symbols displayed at the symbol display positions of the selected second reel into the selected C symbol. That is, for the selected second reel 206*b*, the gaming system modified: (i) the G symbol 202*b* at symbol display position 204*b* to C symbol 202*p*, (ii) the D symbol 202*g* at symbol display position 204*g* to C symbol q, and (iii) the E symbol 202*l* at symbol display position 204*l* to C symbol r. In this example, the gaming system provides appropriate messages such as "THE SYMBOLS ON THE SECOND REEL HAVE BEEN MODIFIED TO A STACK OF C SYMBOLS" to the player visually, or through suitable audio or audiovisual displays.

After the modification of one or more symbols displayed at one or more symbol display positions the gaming system returns to block 108 of FIG. 1 determines and displays any awards associated with the displayed symbols and proceeds as described above.

For example, as seen in FIG. 2D, the gaming system determined that the stacks of C symbols displayed at the symbol display positions associated with the first reel, the second reel and the third reel, respectively, are winning symbol combinations associated with a total award of five-hundred credits. Following this award determination and the subsequent determination that no additional symbol stack modification event occurred, the gaming system concludes the play of the game. In this example, the gaming system provides appropriate messages such as "THE GENERATED SYMBOLS FORMED WINNING SYMBOL COMBINATIONS ASSOCIATED WITH A TOTAL AWARD OF 500" and "GREAT WIN" to the player visually, or through suitable audio or audiovisual displays.

In one embodiment, a symbol stack modification event occurs if each of at least two stacks of symbols include identical symbols. For example, as seen in FIG. 2A, the symbol stack modification event occurred because both stacks of symbols were of the same C symbol. In another embodiment, a symbol stack modification event occurs if the gaming system displays at least stacks of different symbols. In one such embodiment, a symbol stack modification event occurs if the gaming system displays at least stacks of different, but related symbols. In another embodiment, a symbol stack modification event occurs regardless of any relation between the symbols on the first stack and symbols on the second stack.

In another embodiment, a symbol stack modification event occurs if a plurality of the symbol display positions associated with at least two reels each display identical symbols. In another embodiment, a symbol stack modification event occurs if each of the symbol display positions associated with at least two reels each display identical symbols.

In one embodiment, as described above, a symbol stack modification event occurs if the gaming system displays at least two stacks of symbols associated with at least two non-adjacent reels. In another embodiment, a symbol stack modification event occurs if the gaming system displays at least two stacks of symbols associated with at least two adjacent reels. In another embodiment, a symbol stack modification event occurs if the gaming system displays at least two stacks of symbols associated with at least two reels, regardless of if the at least two reels are adjacent to each other. In another embodiment, a symbol stack modification event occurs if the gaming system displays at least full two stacks of symbols associated with at least two of the three leftmost reels, regardless of if the at least two reels are adjacent to each other. In another embodiment, a symbol stack modification event occurs if the gaming system displays at least full two stacks of symbols associated with at least two of the three rightmost reels, regardless of if the at least two reels are adjacent to each other.

Figure 3A:
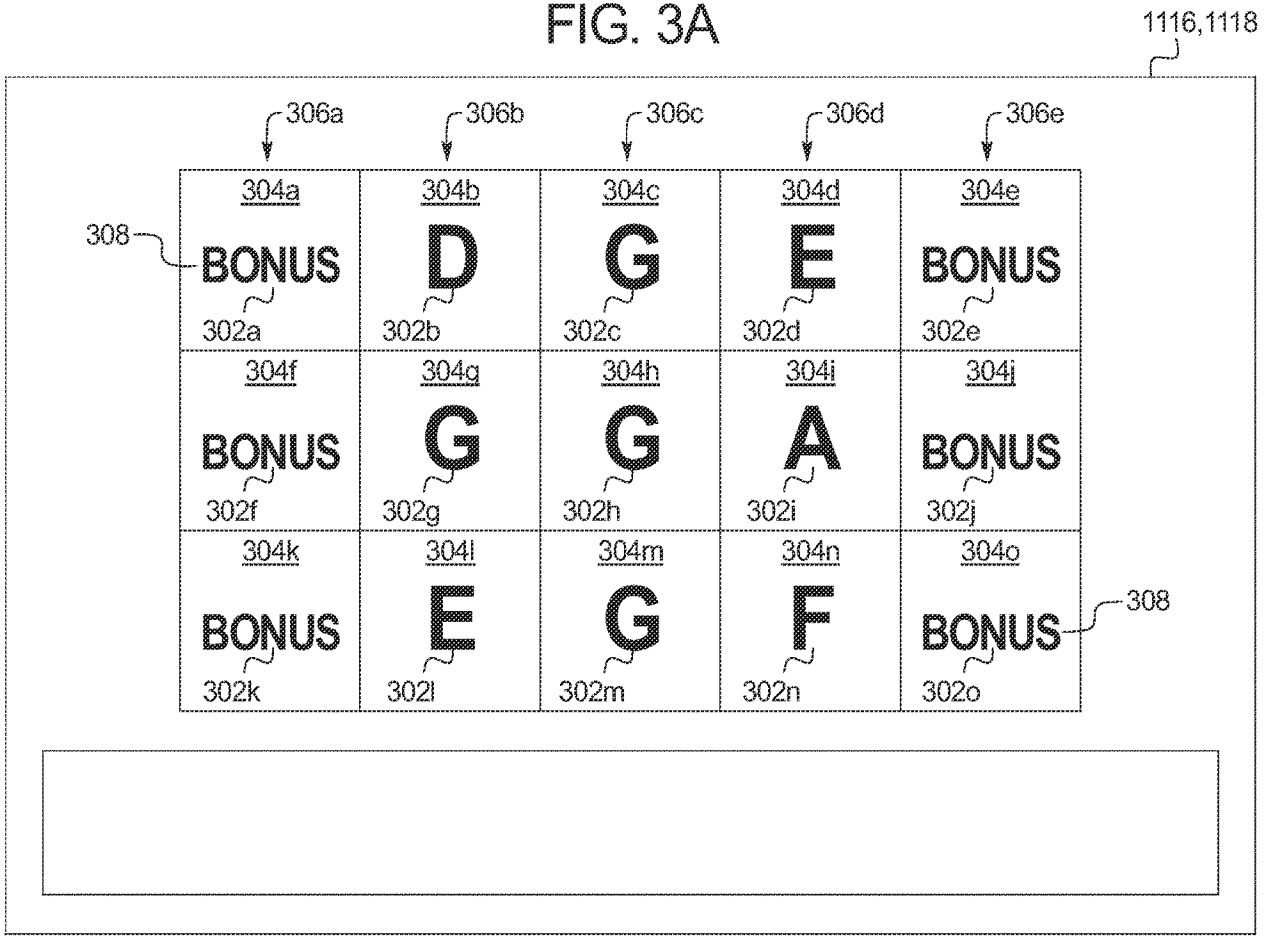
FIGS. 3A and 3B are front views of one embodiment of the gaming system disclosed herein illustrating a modification of each non-stack symbol into a stack of symbols.

In another embodiment, as described above, a symbol stack modification event occurs if the gaming system displays at least two stacks of symbols associated with at least two non-adjacent reels with a non-stacked symbols displayed on the reel between the non-adjacent reels. In another embodiment, a symbol stack modification event occurs if a stack of designated symbols are displayed at the symbol display positions associated with at least two reels. In one such embodiment, the designated symbols are wild symbols such that a symbol stack modification event occurs if a stack of wild symbols are displayed at the symbol display positions associated with at least two reels. In one such embodiment, the designated symbols are bonus symbols such that a symbol stack modification event occurs if a stack of bonus symbols are displayed at the symbol display positions associated with at least two reels. For example, as seen in FIG. 3A, the gaming system determined that a symbol stack modification event occurred because each of the symbol display positions associated with at least two reels each display bonus symbols 308.

In different embodiments, as described above, a symbol stack modification event occurs based on an outcome associated with one or more plays of any primary games. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes such conditions to be satisfied and/or one or more of such events to occur.

In another embodiment, the gaming system causes a symbol stack modification event to occur independent of any displayed events associated with any plays of any games. In another embodiment the gaming system tracks the occurrences of one or more suitable events occurring at or in association with one or more players and/or one or more games and determines, based on these tracked events, whether a symbol stack modification event occurs. In another embodiment, the gaming system defines one or more game play parameters, such as a wager amount or a maximum wager amount, wherein the gaming system determines whether a symbol stack modification event occurs based on a player's tracked game play activity satisfying the defined parameter.

In certain embodiments, the gaming system does not provide any apparent reasons to the players for an occurrence of a symbol stack modification event. In these embodiments, such determinations are not triggered by an event in a primary game or based specifically on any of the plays of any primary games. That is, these events occur without any explanation or alternatively with simple explanations.

In one such embodiment, a symbol stack modification event occurs based on an amount of coin-in. In this embodiment, the gaming system determines if an amount of coin-in reaches or exceeds a designated amount of coin-in (i.e., a threshold coin-in amount). Upon the amount of coin-in wagered reaching or exceeding the threshold coin-in amount, the gaming system causes one or more of such events or conditions to occur. In another such embodiment, a symbol stack modification event occurs based on an amount of virtual currency-in. In this embodiment, the gaming system determines if an amount of virtual currency-in wagered reaches or exceeds a designated amount of virtual currency-in (i.e., a threshold virtual currency-in amount). Upon the amount of virtual currency-in wagered reaching or exceeding the threshold virtual currency-in amount, the gaming system causes one or more of such events or conditions to occur. In different embodiments, the threshold coin-in amount and/or the threshold virtual currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In one such embodiment, a symbol stack modification event occurs based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes one or more of such events or conditions to occur. In another such embodiment, a symbol stack modification event occurs based on an amount of virtual currency-out. In this embodiment, the gaming system determines if an amount of virtual currency-out reaches or exceeds a designated amount of virtual currency-out (i.e., a threshold virtual currency-out amount). Upon the amount of virtual currency-out reaching or exceeding the threshold virtual currency-out amount, the gaming system causes one or more of such events or conditions to occur. In different embodiments, the threshold coin-out amount and/or the threshold virtual currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In different embodiments, a symbol stack modification event occurs based on a predefined variable reaching a defined parameter threshold. For example, when the $500{,}000^{th}$ player has played an electronic gaming machine (ascertained from a player tracking system), one or more of such events or conditions occur. In different embodiments, the predefined parameter thresholds include a length of time, a length of time after a certain dollar amount is hit, a wager level threshold for a specific device (which electronic gaming machine is the first to contribute $250,000), a number of electronic gaming machines active, or any other parameter that defines a suitable threshold.

In different embodiments, a symbol stack modification event occurs based on a quantity of games played. In this embodiment, a quantity of games played is set for when one or more of such events or conditions will occur. In one embodiment, such a set quantity of games played is based on historic data.

In different embodiments, a symbol stack modification event occurs based on time. In this embodiment, a time is set for when one or more of such events or conditions will occur. In one embodiment, such a set time is based on historic data.

In different embodiments, a symbol stack modification event occurs based upon gaming system operator defined player eligibility parameters stored on a player tracking system (such as via player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the electronic gaming machine. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In different embodiments, a symbol stack modification event occurs based on a system determination, including one or more random selections by the central controller. In one embodiment, as described above, the gaming system tracks all active electronic gaming machines and the wagers they placed. In one such embodiment, based on the electronic gaming machine's state as well as one or more wager pools associated with the electronic gaming machine, the gaming system determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In different embodiments, a symbol stack modification event occurs based on a determination of if any numbers allotted to an electronic gaming machine match a randomly selected number. In this embodiment, upon or prior to each play of each electronic gaming machine, an electronic gaming machine selects a random number from a range of numbers and during each primary game, the electronic gaming machine allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a symbol stack modification event to occur may be implemented in accordance with the gaming system and method disclosed herein.

It should be appreciated that one or more of the above-described triggers pertaining to one or more of such triggering events occurring may be combined in one or more different embodiments.

Figure 3B:
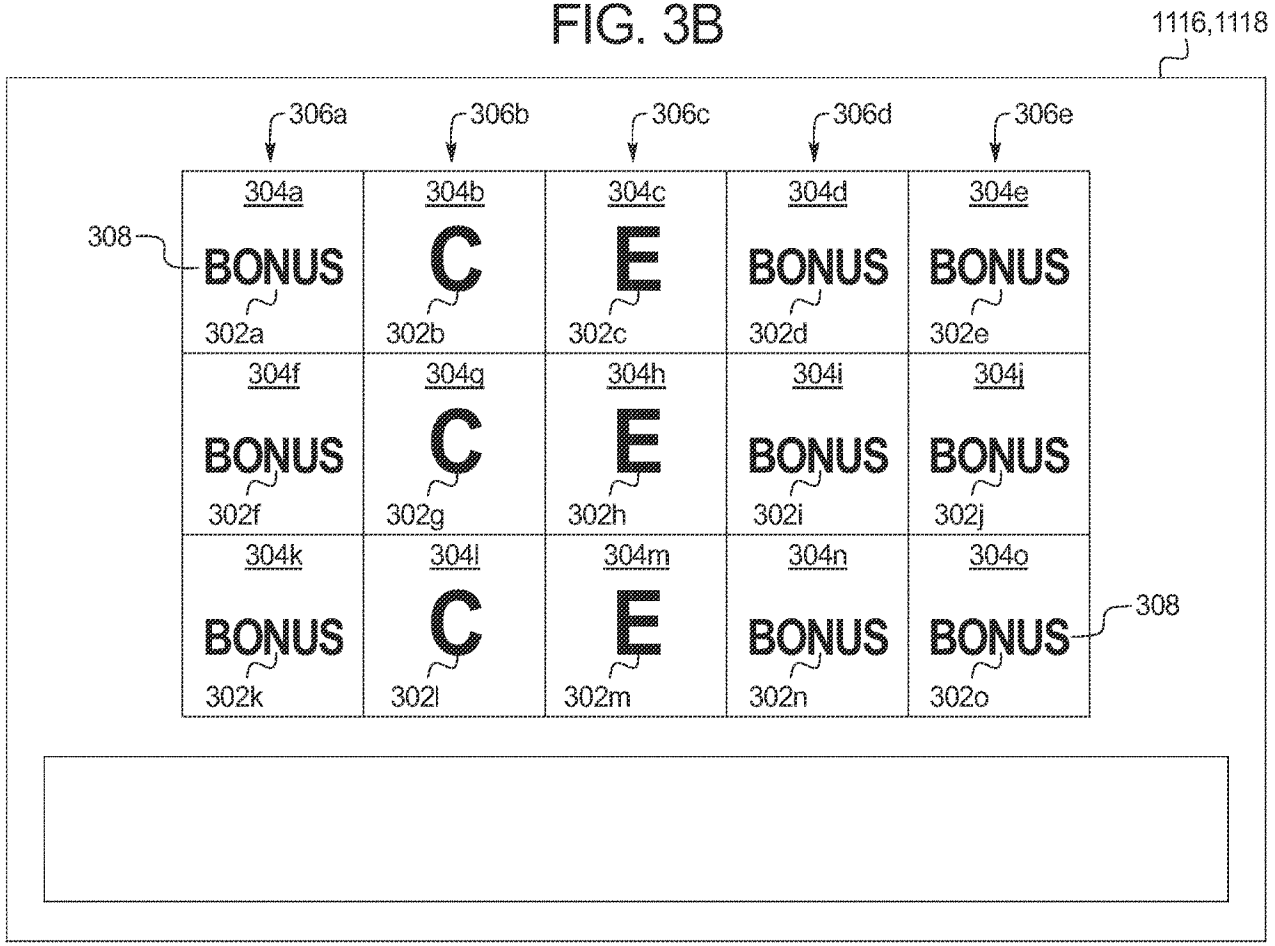

In one embodiment, as described above, if a symbol stack modification event occurs, the gaming system selects one or more reels to modify the symbols of. In one such embodiment, if the gaming system selects a plurality of reels to modify one or more symbols of, the gaming system selects the same symbol for each of the plurality of reels. In another such embodiment, if the gaming system selects a plurality of reels to modify one or more symbols of, the gaming system selects different, but related symbols for each of the plurality of reels. In another such embodiment, if the gaming system selects a plurality of reels to modify one or more symbols of, the gaming system selects different symbols for each of the plurality of reels. For example, as seen in FIG. 3B, the gaming system: (i) modified the symbols displayed at the symbol display positions associated with the second reel to C symbols, (ii) modified the symbols displayed at the symbol display positions associated with the third reel to E symbols, and (iii) modified the symbols displayed at the symbol display positions associated with the fourth reel to bonus symbols.

In another embodiment, if a symbol stack modification event occurs, the gaming system selects one or more reels to modify a plurality of the symbols of. In one such embodiment, if a symbol stack modification event occurs, the gaming system selects one or more reels to modify less than all of the displayed symbols of. That is, if a symbol stack modification event occurs, the gaming system selects one or more (but not each) of the symbol display positions of one or more reels and then modifies the symbols of the selected symbol display positions. For example, if a symbol stack modification event occurs, the gaming system selects the first and second rows of a non-stacked reel and proceeds to modify the symbols of the selected first and second row to one or more modified symbols.

In another embodiment, if a symbol stack modification event occurs, the gaming system selects one or more reels to modify and then determines if the symbols displayed at the symbol display positions of the selected reel(s) are designated symbols. In this embodiment, if the gaming system determines that the symbols displayed at the symbol display positions of the selected reel(s) are designated symbols, the gaming system proceed with modifying such symbols. On the other hand, if the gaming system determines that the symbols displayed at the symbol display positions of the selected reel(s) are not designated symbols, the gaming system does not modify such symbols. For example, if a symbol stack modification event occurs, the gaming system selects one or more non-stacked reels and then changes each of the high value symbols (i.e., the most lucrative symbols) on the selected reel(s) to one or more different symbols. In another example, if a symbol stack modification event occurs, the gaming system selects one or more non-stacked reels and then changes each of the low value symbols (i.e., the least lucrative symbols) on the selected reel(s) to high value symbols.

In another embodiment, the game employing a plurality of stacks of symbols is employed as a cascading symbol or tumbling reel games. In this embodiment, before and/or after the above-described modification of any symbols, the gaming system removes one or more displayed symbols, such as any symbols that form any winning symbol combinations, to create one or more empty symbol display positions. The gaming system then shifts zero, one, or more of the remaining displayed symbols downward into zero, one, or more of the created empty symbol display positions. If any empty symbol display positions remain, the gaming system displays a symbol for each remaining empty symbol display position. The gaming machine then reevaluates the displayed symbols and provides an award for any winning symbol combinations formed.

In another embodiment, the game employing a plurality of stacks of symbols is a community game. In this embodiment, each of a plurality of players playing a plurality of electronic gaming machines participate in the play of the game employing a plurality of stacks of symbols. In one embodiment, the game employing a plurality of stacks of symbols is a cooperative community game wherein a plurality of players cooperate or play together. In another embodiment, the game employing a plurality of stacks of symbols is a competition community game wherein a plurality of players compete or play against each other.

In one embodiment, the gaming system causes at least one display device of at least one electronic gaming machine to display the game employing stacked symbols. In one such embodiment, the gaming system causes a supplemental display device, such as a top box, of an electronic gaming machine to display the game employing stacked symbols. In another such embodiment, the gaming system causes the game employing stacked symbols to be displayed in one or more service windows or pop-up screens. In another embodiment, in addition or in alternative to each electronic gaming machine displaying the game employing stacked symbols, one or more players, the gaming system causes one or more community or overhead display devices to display part or all of the game employing stacked symbols to one or more other players or bystanders either at a gaming establishment or viewing over a network, such as the internet. In another embodiment, in addition or in alternative to each electronic gaming machine displaying the game employing stacked symbols, the gaming system causes one or more internet sites to each display the game employing stacked symbols such that a player is enabled to log on from a personal web browser. In another such embodiment, the gaming system enables the player to play one or more games on one device while viewing the game employing stacked symbols from another device, such as a desktop or laptop computer.

In different embodiments, one or more awards provided in association with one or more primary game plays, and/or one or more secondary game plays include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product such as a free teddy bear, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on an internet.

Alternative Embodiments

It should be appreciated that in different embodiments, one or more of:

i. which symbols to display one or more stacks of symbols, ii. a quantity of stacks of symbols displayed, iii. which symbol stack modification event to utilize, iv. which reels are selected to modify the displayed symbols of, v. a quantity of reels selected to modify the displayed symbols of, vi. which symbols are selected to modify one or more non-stacked symbols into;

vii. a quantity of symbols selected to modify one or more non-stacked symbols into;

viii. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection or input, determined independent of a player's selection or input, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
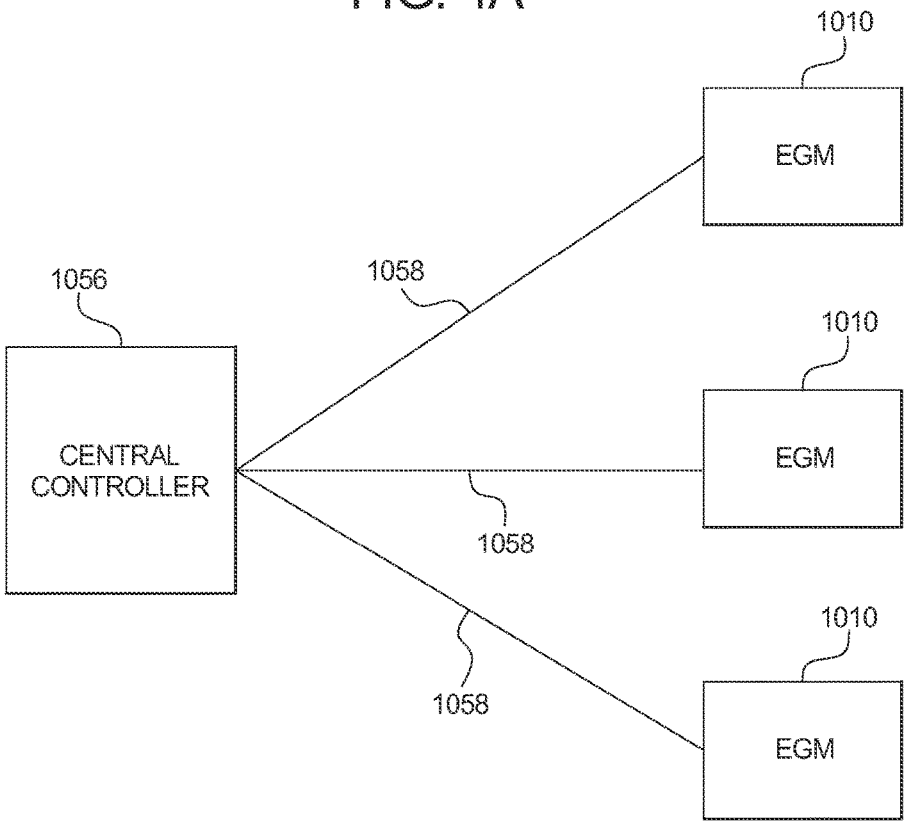
FIG. 4A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes; (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
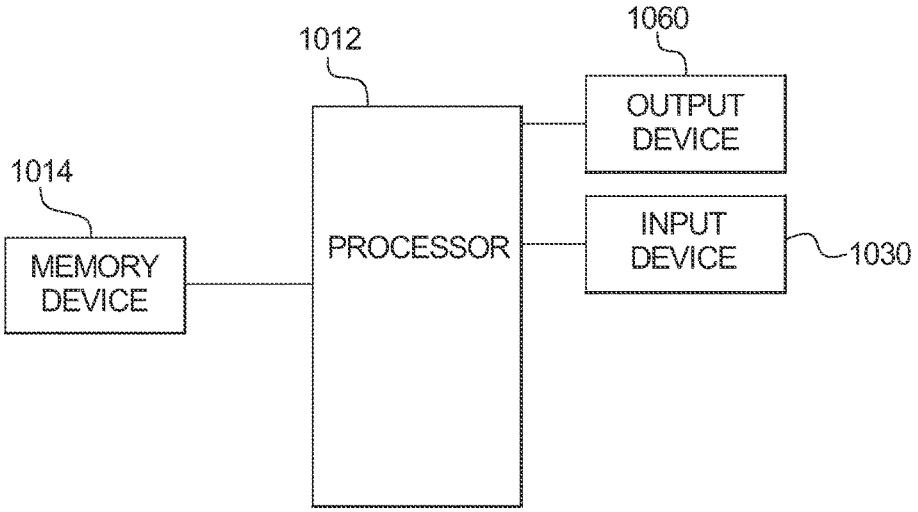
FIG. 4B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
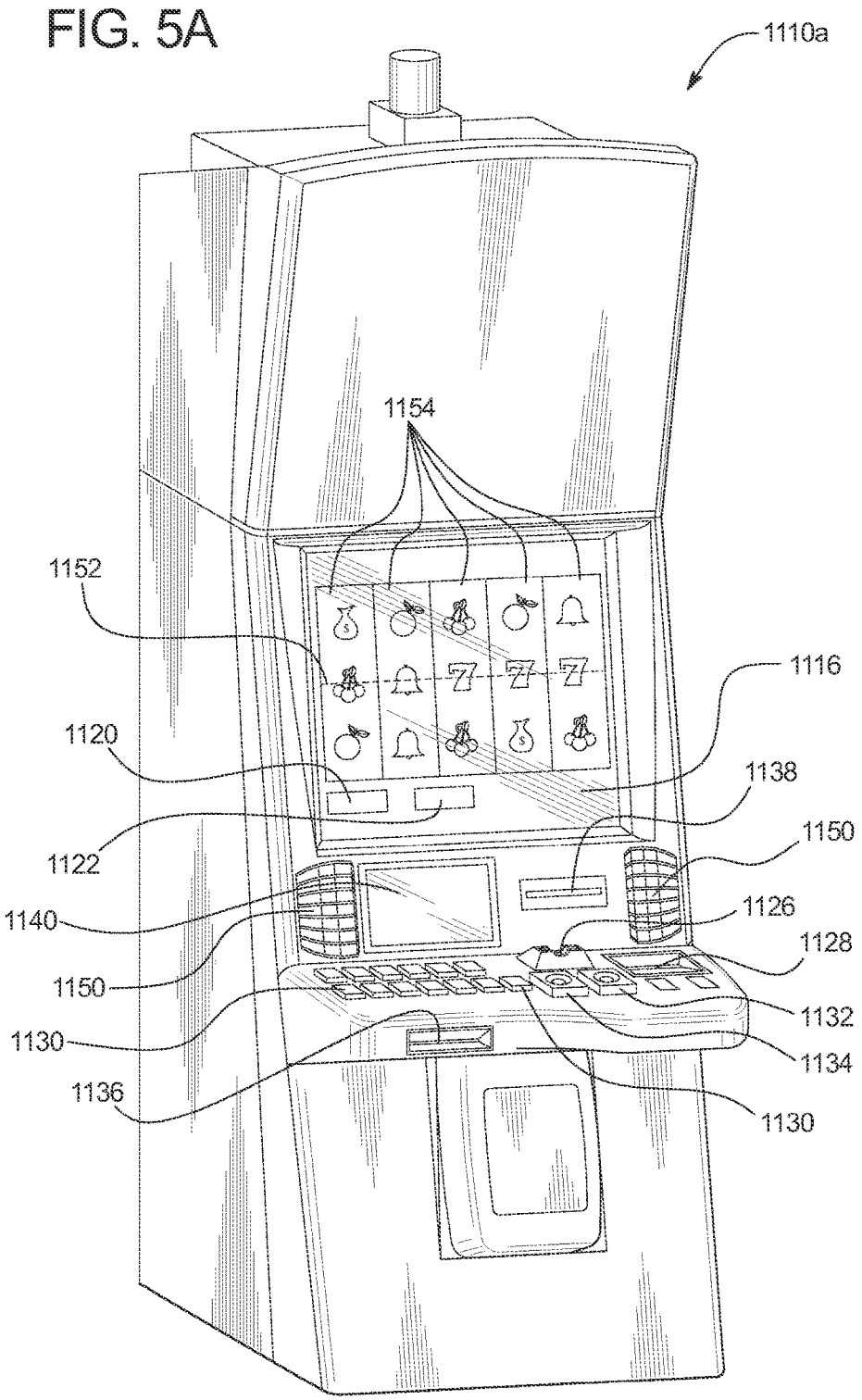
FIGS. 5A and 5B are perspective views of example alternative embodiments of the gaming system disclosed herein.
Figure 5B:
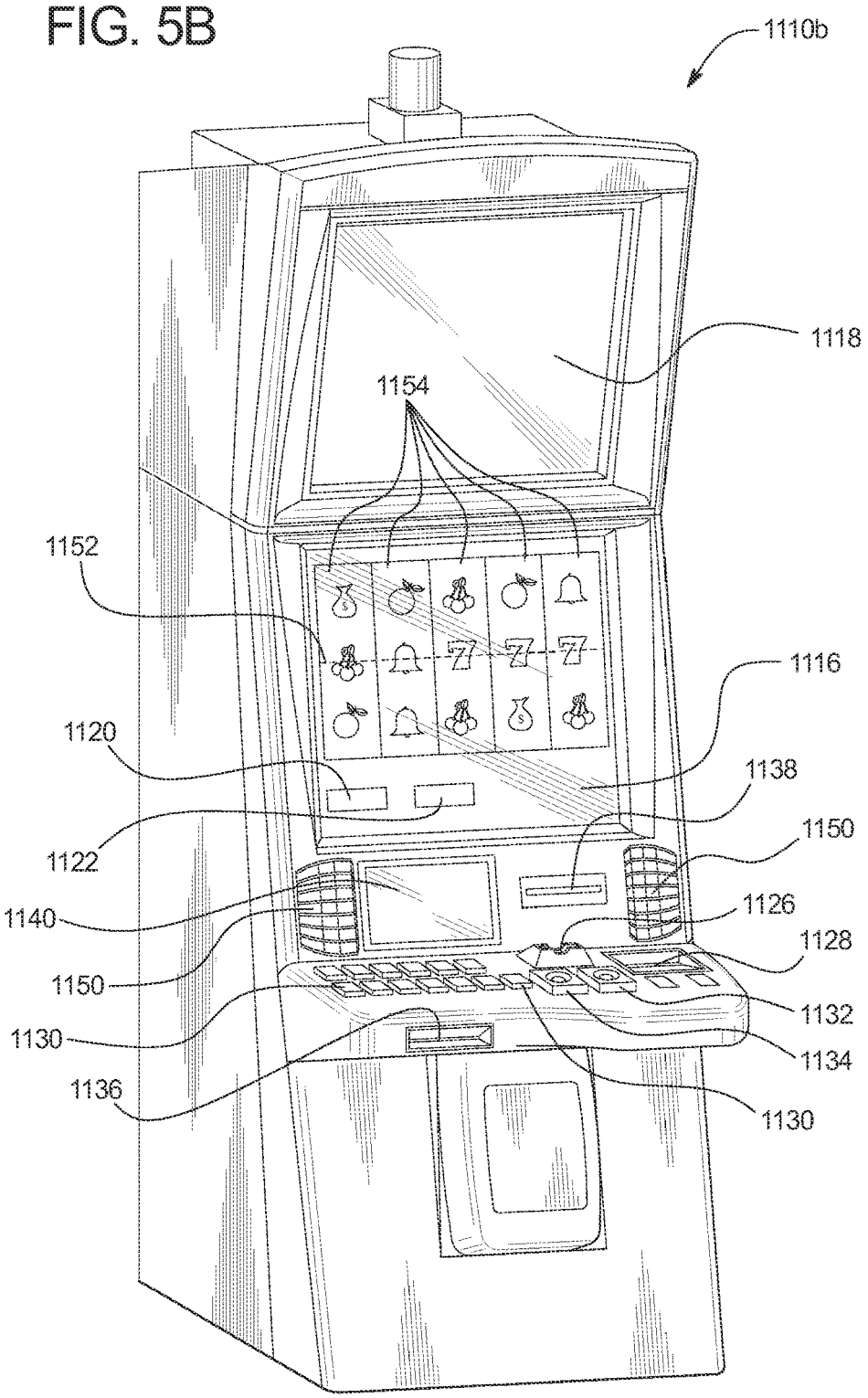

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 1138. The card reader is configured to read a player identification card inserted into the card reader.

In various embodiments, the EGM includes one or more output devices. The example EGM illustrated in FIG. 4B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display: (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 1116, a player tracking display 1140, a credit display 1120, and a bet display 1122. The example EGM illustrated in FIG. 5B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (C) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281561 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 5A and 5B each include a payline 1152 and a plurality of reels 1156. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary genie cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one processor; and at least one memory device which stores a plurality of instructions, which when executed by the at least one processor, cause the at least one processor to:

at each of a plurality of symbol display positions associated with a plurality of reels, cause the at least one display device to display a symbol from a plurality of symbols, determine if a symbol stack modification event occurred, said determination being based, at least in part, on if related symbols are displayed at: (i) each of a plurality of symbol display positions associated with a first one of the reels, and (ii) each of a plurality of symbol display positions associated with a second one of the reels, wherein for each of the reels, said plurality of any displayed related symbols form a stack of symbols, responsive to the symbol stack modification event occurring:

independent of the first one of the reels and the second one of the reels, randomly select any one of the reels different from each of the first one of the reels and the second one of the reels, randomly select one of the plurality of symbols, and modify a plurality of the symbols displayed at a plurality of the symbol display positions associated with the randomly selected reel to the randomly selected symbol, determine any awards associated with the displayed symbols, and cause the at least one display device to display any determined awards.

2. The gaming system of claim 1, wherein when executed by the at least one processor responsive to the symbol stack modification event occurring, the plurality of instructions cause the at least one processor to:

independent of the first one of the reels and the second one of the reels, randomly select a plurality of the reels different from each of the first one of the reels and the second one of the reels, for each of the randomly selected reels, randomly select one of the plurality of symbols, and for each of the randomly selected reels, modify each of the symbols displayed at each of the symbol display positions associated with the randomly selected reel to the randomly selected symbol.

3. The gaming system of claim 1, wherein said determination of if the symbol stack modification event occurred is based, at least in part, on if related symbols are displayed at each of the plurality of symbol display positions associated with two non-adjacent reels of the plurality of reels.

4. The gaming system of claim 3, wherein when executed by the at least one processor responsive to the symbol stack modification event occurring, the plurality of instructions cause the at least one processor to randomly select one of the reels between the two non-adjacent reels.

5. The gaming system of claim 1, wherein when executed by the at least one processor, the plurality of instructions cause the at least one processor to determine any awards associated with the displayed symbols prior to determining if the symbol stack modification event occurred.

6. The gaming system of claim 1, wherein the related symbols includes bonus symbols.

7. The gaming system of claim 1, wherein the related symbols include identical symbols.

8. The gaming system of claim 1, wherein any determined award is at least one of: a quantity of monetary credits, a quantity of non-monetary credits, a quantity of promotional credits, and a quantity of player tracking points.

9. The gaming system of claim 1, wherein when executed by the at least one processor responsive to the symbol stack modification event occurring, the plurality of instructions cause the at least one processor to modify each of the symbols displayed at each of the symbol display positions associated with the randomly selected reel to the randomly selected symbol.

10. The gaming system of claim 1, which includes a plurality of input devices including an acceptor, wherein when executed by the at least one processor, the plurality of instructions cause the at least one processor to operate with the plurality of input devices to: responsive to a physical item being received via the acceptor, establish a credit balance based, at least in part, on a monetary value associated with the received physical item, and responsive to a cashout input being received, cause an initiation of any payout associated with the credit balance.

11. A gaming system server comprising:

at least one processor; and at least one memory device which stores a plurality of instructions, which when executed by the at least one processor, cause the at least one processor to:

transmit data which results in a display device displaying, at each of a plurality of symbol display positions associated with a plurality of reels, a symbol from a plurality of symbols, determine if a symbol stack modification event occurred, said determination being based, at least in part, on if related symbols are displayed at: (i) each of a plurality of symbol display positions associated with a first one of the reels, and (ii) each of a plurality of symbol display positions associated with a second one of the reels, wherein for each of the reels, said plurality of any displayed related symbols form a stack of symbols, responsive to the symbol stack modification event occurring:

independent of the first one of the reels and the second one of the reels, randomly select any one of the reels different from each of the first one of the reels and the second one of the reels, randomly select one of the plurality of symbols, and transmit data which results in the display device displaying a modification of a plurality of the symbols displayed at a plurality of the symbol display positions associated with the randomly selected reel to the randomly selected symbol, determine any awards associated with the displayed symbols, and transmit data which results in the display device displaying any determined awards.

12. The gaming system server of claim 11, wherein when executed by the at least one processor responsive to the symbol stack modification event occurring, the plurality of instructions cause the at least one processor to:

independent of the first one of the reels and the second one of the reels, randomly select a plurality of the reels different from each of the first one of the reels and the second one of the reels, for each of the randomly selected reels, randomly select one of the plurality of symbols, and transmit data which results in the display device displaying a modification, for each of the randomly selected reels, each of the symbols displayed at each of the symbol display positions associated with the randomly selected reel to the randomly selected symbol.

13. The gaming system server of claim 11, wherein said determination of if the symbol stack modification event occurred is based, at least in part, on if related symbols are displayed at each of the plurality of symbol display positions associated with two non-adjacent reels of the plurality of reels.

14. The gaming system server of claim 13, wherein when executed by the at least one processor responsive to the symbol stack modification event occurring, the plurality of instructions cause the at least one processor to randomly select one of the reels between the two non-adjacent reels.

15. The gaming system server of claim 11, wherein when executed by the at least one processor, the plurality of instructions cause the at least one processor to determine any awards associated with the displayed symbols prior to determining if the symbol stack modification event occurred.

16. The gaming system server of claim 11, wherein the related symbols includes bonus symbols.

17. The gaming system server of claim 11, wherein the related symbols include identical symbols.

18. The gaming system server of claim 11, wherein any determined award is at least one of: a quantity of monetary credits, a quantity of non-monetary credits, a quantity of promotional credits, and a quantity of player tracking points.

19. The gaming system server of claim 11, wherein when executed by the at least one processor responsive to the symbol stack modification event occurring, the plurality of instructions cause the at least one processor to modify each of the symbols displayed at each of the symbol display positions associated with the randomly selected reel to the randomly selected symbol.

20. The gaming system server of claim 11, which transmits and receives data over a data network.

21. The gaming system server of claim 20, wherein the data network is an internet.

22. The gaming system server of claim 11, wherein a credit balance is increasable based on any determined award, said credit balance being increasable via an acceptor of a physical item associated with a monetary value, and said credit balance being decreasable via a cashout device.

23. A method of operating a gaming system, said method comprising:

at each of a plurality of symbol display positions associated with a plurality of reels, causing a display, via a display device, of a symbol from a plurality of symbols, determining, by at least one processor, if a symbol stack modification event occurred, said determination being based, at least in part, on if related symbols are displayed at: (i) each of a plurality of symbol display positions associated with a first one of the reels, and (ii) each of a plurality of symbol display positions associated with a second one of the reels, wherein for each of the reels, said plurality of any displayed related symbols form a stack of symbols, responsive to the symbol stack modification event occurring:

independent of the first one of the reels and the second one of the reels, randomly selecting, by the at least one processor, any one of the reels different from each of the first one of the reels and the second one of the reels, randomly selecting, by the at least one processor, one of the plurality of symbols, and causing a display, via the display device, of a modification of a plurality of the symbols displayed at a plurality of the symbol display positions associated with the randomly selected reel to the randomly selected symbol, determining, by the at least one processor, any awards associated with the displayed symbols, and causing a display, via the display device, of any determined awards.

24. The method of claim 23, further comprising, responsive to the symbol stack modification event occurring:

independent of the first one of the reels and the second one of the reels, randomly selecting, by the at least one processor, a plurality of the reels different from each of the first one of the reels and the second one of the reels, for each of the randomly selected reels, randomly selecting, by the at least one processor, one of the plurality of symbols, and for each of the randomly selected reels, causing a display, via the display device, of a modification of each of the symbols displayed at each of the symbol display positions associated with the randomly selected reel to the randomly selected symbol.

25. The method of claim 23, wherein said determination of if the symbol stack modification event occurred is based, at least in part, on if related symbols are displayed at each of the plurality of symbol display positions associated with two non-adjacent reels of the plurality of reels.

26. The method of claim 25, further comprising, responsive to the symbol stack modification event occurring, causing the at least one processor to execute the plurality of instructions to select one of the reels between the two non-adjacent reels.

27. The method of claim 23, further comprising causing the at least one processor to execute the plurality of instructions to determine any awards associated with the displayed symbols prior to determining if the symbol stack modification event occurred.

28. The method of claim 23, wherein the related symbols includes bonus symbols.

29. The method of claim 23, wherein the related symbols include identical symbols.

30. The method of claim 23, wherein any determined award is at least one of: a quantity of monetary credits, a quantity of non-monetary credits, a quantity of promotional credits, and a quantity of player tracking points.

31. The method of claim 23, further comprising, responsive to the symbol stack modification event occurring, causing the at least one processor to execute the plurality of instructions to modify each of the symbols displayed at each of the symbol display positions associated with the randomly selected reel to the randomly selected symbol.

32. The method of claim 23, which is executed through a data network.

33. The method of claim 32, wherein the data network is an internet.

34. The method of claim 23, wherein a credit balance is increasable based on any determined award, said credit balance being increasable via an acceptor of a physical item associated with a monetary value, and said credit balance being decreasable via a cashout device.

* * * * *